US009761132B2

(12) United States Patent
Watts-Fitzgerald et al.

(10) Patent No.: US 9,761,132 B2
(45) Date of Patent: Sep. 12, 2017

(54) METHOD AND APPARATUS FOR PROVIDING DYNAMIC STRENGTH DECAY FOR PREDICTIVE TRAFFIC

(71) Applicant: HERE Global B.V., Veldhoven (NL)

(72) Inventors: Colin Watts-Fitzgerald, Forest Park, IL (US); Michael Weinberger, Chicago, IL (US); Shu Xie, Chicago, IL (US)

(73) Assignee: HERE Global B.V., Veldhoven (NL)

( * ) Notice: Subject to any disclaimer, the term of this patent is extended or adjusted under 35 U.S.C. 154(b) by 4 days.

(21) Appl. No.: 14/674,664

(22) Filed: Mar. 31, 2015

(65) Prior Publication Data

US 2016/0292999 A1 Oct. 6, 2016

(51) Int. Cl.
*G08G 1/01* (2006.01)

(52) U.S. Cl.
CPC ..... *G08G 1/0129* (2013.01)

(58) Field of Classification Search
CPC ..... G08G 1/0125; G08G 1/0129
USPC ..... 701/117
See application file for complete search history.

(56) References Cited

U.S. PATENT DOCUMENTS

2014/0032091 A1* 1/2014 Arcot ..... G08G 1/0129 701/119

* cited by examiner

*Primary Examiner* — Anne M Antonucci
(74) *Attorney, Agent, or Firm* — Ditthavong & Steiner, P.C.

(57) ABSTRACT

An approach is provided for determining one or more varying decay rates associated with one or more road segments. The approach involves causing, at least in part, a decaying of real-time traffic data to historical traffic data associated with the one or more road segments based, at least in part, on the one or more varying decay rates. The approach also involves determining one or more traffic predictions for the one or more road segments based, at least in part, on the decaying of the real-time traffic data to the historical traffic data.

20 Claims, 12 Drawing Sheets

300

400

500

600

700

METHOD AND APPARATUS FOR PROVIDING DYNAMIC STRENGTH DECAY FOR PREDICTIVE TRAFFIC

BACKGROUND

Service providers and device manufacturers (e.g., wireless, cellular, etc.) are continually challenged to deliver value and convenience to consumers by, for example, providing compelling network services. One area of interest has been the development of predictive traffic applications (e.g. traffic speed, traffic volume, etc.) as a means of conveying real-time traffic information to the users. However, when displaying mapping and/or navigation information for users, there is currently little application of traffic variability, especially for individual roads, to the predictive models (e.g. high traffic, road closure, opening soon, etc.). This problem may be particularly acute for users accessing information for locations with highly variable traffic (e.g. time of day, week, etc.). Accordingly, service providers and developers face significant technical challenges in incorporating traffic variability to predictive models in mapping and/or navigation applications.

SOME EXAMPLE EMBODIMENTS

Therefore, there is a need for an approach for causing traffic predictions based, at least in part, on decaying of real-time traffic data to historical traffic data.

According to one embodiment, a method comprises determining one or more varying decay rates associated with one or more road segments. The method also comprises causing, at least in part, a decaying of real-time traffic data to historical traffic data associated with the one or more road segments based, at least in part, on the one or more varying decay rates. The method further comprises determining one or more traffic predictions for the one or more road segments based, at least in part, on the decaying of the real-time traffic data to the historical traffic data.

According to another embodiment, an apparatus comprises at least one processor, and at least one memory including computer program code, the at least one memory and the computer program code configured to, with the at least one processor, cause, at least in part, the apparatus to determine one or more varying decay rates associated with one or more road segments. The apparatus is also caused to cause, at least in part, a decaying of real-time traffic data to historical traffic data associated with the one or more road segments based, at least in part, on the one or more varying decay rates. The apparatus is further caused to determine one or more traffic predictions for the one or more road segments based, at least in part, on the decaying of the real-time traffic data to the historical traffic data.

According to another embodiment, a computer-readable storage medium carries one or more sequences of one or more instructions which, when executed by one or more processors, cause, at least in part, an apparatus to determine one or more varying decay rates associated with one or more road segments. The apparatus is also caused to cause, at least in part, a decaying of real-time traffic data to historical traffic data associated with the one or more road segments based, at least in part, on the one or more varying decay rates. The apparatus is further caused to determine one or more traffic predictions for the one or more road segments based, at least in part, on the decaying of the real-time traffic data to the historical traffic data.

According to another embodiment, an apparatus comprises means for determining one or more varying decay rates associated with one or more road segments. The apparatus also comprises means for causing, at least in part, a decaying of real-time traffic data to historical traffic data associated with the one or more road segments based, at least in part, on the one or more varying decay rates. The apparatus further comprises means for determining one or more traffic predictions for the one or more road segments based, at least in part, on the decaying of the real-time traffic data to the historical traffic data.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (including derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for causing traffic predictions based, at least in part, on decaying of real-time traffic data to historical traffic data, are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

Although various embodiments are described with respect to determining decay rates using historic data, it is contemplated that a variety of data sources could be used as historic data or to supplement the historic data including crowd source data, network information, public databases, public information (public transport schedules, etc.), and other like information. These data sources may be augmented with information related to particular roads, points-of-interest, geographic locations, city information (e.g. construction, permits) and the like. Also, it may include information related to factors (increasing/mitigating factors etc.) of contributing to road congestion that effect a traffic flow for one or more road segments of interest.

Although various embodiments are described with respect to determining decay rates using real-time data, it is contemplated that a variety of data sources could be used as real-time data or to supplement the real-time data including crowd source data, network information, public databases, public information (public transport schedules, etc.), and other like information. These data sources may be augmented with information related to particular roads, points-of-interest, geographic locations, city information (e.g. construction, permits) and the like. Also, it may include information related to factors (increasing/mitigating factors etc.) of contributing to road congestion that effect a traffic flow for one or more road segments of interest.

Figure 1A:
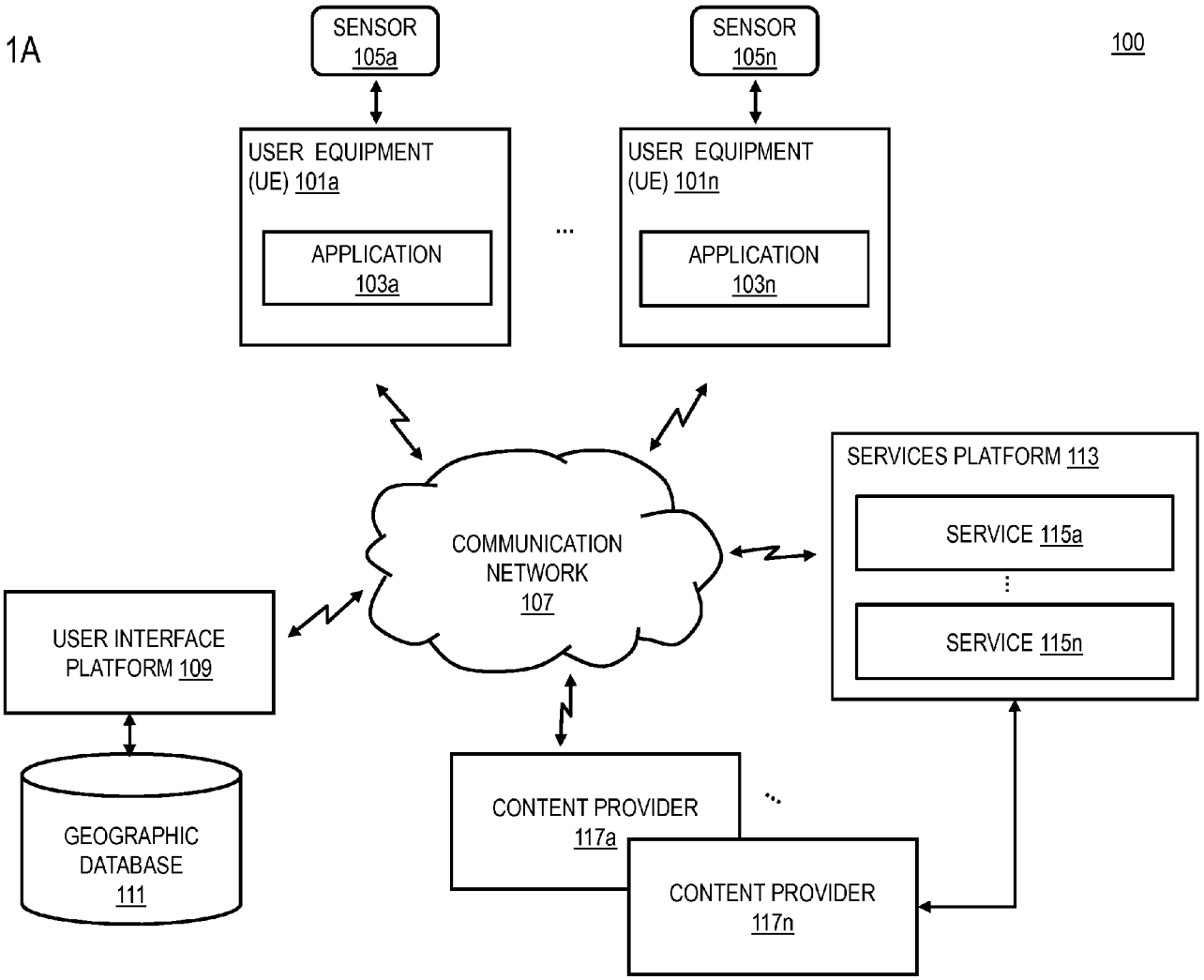
FIG. 1A is a diagram of a system capable of causing traffic predictions based, at least in part, on decaying of real-time traffic data to historical traffic data, according to one embodiment.
Figure 1B:
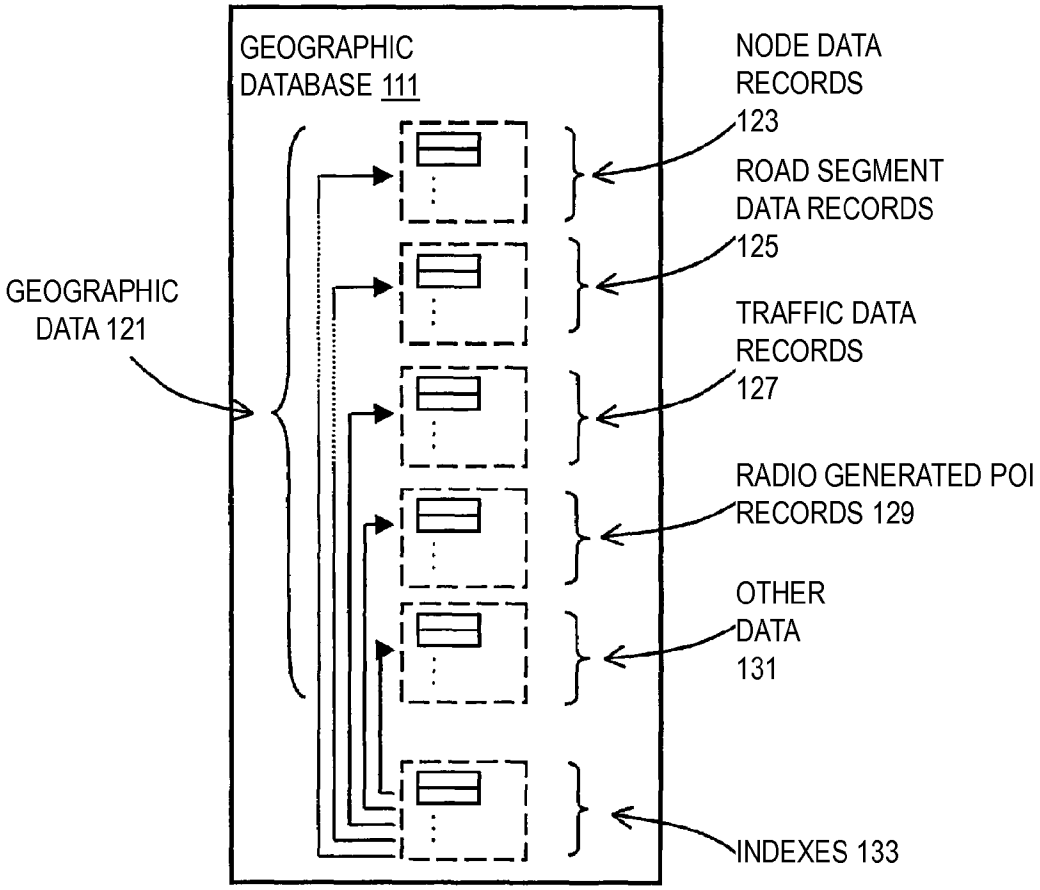
FIG. 1B is a diagram of the components of a geographic database 111, according to one embodiment.

FIG. 1 is a diagram of a system capable of for determining one or more varying decay rates associated with one or more road segments to cause a decaying of real-time traffic data to historical traffic data based on the varying decay rate, then determining traffic predictions based on the decaying of the real-time traffic data to the historical traffic data. As noted above, the determination of traffic predictions may be difficult due to volatility in the data related to congestion or unanticipated traffic patterns. Furthermore, individual roads may vary in pattern (daily, weekly, yearly, etc.) from one to another due to particular circumstances of the individual roads (commute times, work schedules, yearly work patterns, etc.). Also, prediction problems may be endemic in areas under considerable change, such as may be the case in areas of building construction, rezoning, or business volatility. This causes traffic predictions to be problematic and/or inaccurate in such circumstances. This means that navigation or mapping services may provide very limited or inaccurate predictions for many roadways. One way of coping with this shortcoming is to provide appropriate algorithms. Such algorithms may include a use of real-time data in conjunction with historic data to determine a more accurate prediction than may be attained by either real-time or historic data individually.

Moreover, problems with traffic predictability are associated with congestion for one or more road segments. This traffic congestion may be less predictable in some road segments, which may make predictions for individual roads inaccurate or unreliable. Furthermore, aggregated calculations using multiple road segments may be skewed if the ambiguities and difficulties of the congestion information are not taken into account. In fact, congestion traffic makes up the majority of the variance in speeds of roadways, thus identifying when congestion begins or ends for each road segment in real-time is essential to making accurate predictions. Furthermore, these periods of the day are of high priority to customers using map applications for routing estimations. In addition, congestion information may be used in conjunction with other traffic information. Thus, along with traffic congestion, as described, a large portion of roads have unique traffic profiles and differences in the timing and extent of speed variation. Recently, however, these profile differences have been incorporated into traffic prediction related algorithmic programs that can selectively account for modeling differences and provide a more systematic yet individualized approach.

To address this problem, a system 100 of FIG. 1 introduces a new method of determining traffic predictions for one or more road segments based on determining one or more decay rates associated with the road segments. And, furthermore, decaying real-time information to historical traffic data using the varying decay rates for the respective road segments. In one embodiment, the system 100 determines a decay rate for a particular road segment for a determined length of time. This decay begins with 100% real-time information and 0% historic information, and then progressively moves to the inverse (100% historic, 0% real-time). In addition, the decay rate (real-time to historic) may be tailored to each particular road segment. The system 100 can use decay functions, which include both real-time and historic data, such that real-time data is decayed in inverse proportion to an increasing proportion of historic data. Thus, a statistical function using these elements can provide a more nuanced and accurate determination of the traffic flow.

In one embodiment, the system 100 may use one or more algorithmic functions that are either applied to an aggregate of road segments or individualized to the characteristics of a particular road segment. In addition, part of the individualization of the algorithmic function for a particular road segment may include a determination of a decay rate based on variance information, including the standard deviation from one or more sets of historic data. Thus, the decay rate may be of a greater "strength" to include a greater reliance on historic information (such as for congestion) or lower strength for a greater reliance on real-time information (such as for non-congestion intervals of time). In one scenario, the decay rate may be subject to one or more temporal parameters. For example, such temporal parameters may include a particular function that best represents the traffic information over a specified time period. Also, the time interval may be selected to optimally capture the particular traffic behavior. Furthermore, the time intervals may cover select time periods including a day, week, month, season, year, or a combination thereof. In one scenario, once the respective decay rates are determined for temporal intervals of the road segments, one or more traffic predictions may be determined for each road interval for one or more periods of time.

In one embodiment, the system 100 may include a processing of the real-time traffic data, the historical traffic data, or a combination thereof to determine traffic speed variance data for the one or more road segments. Furthermore, the one or more varying decay rates are based, at least in part, on the traffic speed variance data. In one scenario, the system may cause an increasing of the one or more varying decay rates if the traffic speed variance data indicates a high variance above a threshold value. And, simultaneous causing for other intervals, a decreasing of the one or more varying decay rates if the traffic speed variance data indicates a low variance below a threshold value. Thus, a road segment at a select interval of time may be determined to include a standard deviation of historical information greater than a threshold. This may indicate that the said road segment experienced congestion over this time period due to the variances in traffic flow. Thus, a decay rate may be determined to include greater strength and include a plummeting of the real-time data with a concomitantly greater reliance on historical information. In another scenario, a road segment at an interval of time may be determined to include a standard deviation of historical information less than a threshold. This may indicate that the said road segment experienced low congestion over this time period due to the low variances in traffic flow. Thus, a decay rate may be determined to include lower strength and include a longer interval for the real-time data with a concomitantly lower reliance on historical information.

In one embodiment, the system 100 may cause a creation of a traffic profile for one or more road segments based, at least in part, on the historical traffic data, wherein the traffic profile represents expected traffic data for the one or more road segments. Furthermore, the system 100 may determine the varying decay rates based on a determination of deviations of the real-time traffic data from the at least one traffic profile. In one scenario, the system 100 may use historical traffic data for one or more road segments. This historical traffic data may be analyzed to determine the statistical characteristics for each road segment over time. Furthermore, the statistical characteristics may be analyzed for intervals of time over the total time interval to determine high congestion periods, lower congestion periods, and other like characteristics. Thus, a statistical data set that includes a variance greater than a threshold, such that the standard deviation is greater than a threshold may be deemed high congestion. In one embodiment, the system 100 may include time intervals of low variance, such that a standard deviation is less than a threshold. This may be deemed to be a low congestion area. In one scenario, the system 100 may determine that a low variance time interval includes a deviation from normal behavior including the variance behavior. In such situations, the system 100 may place a greater reliance on real-time data to capture the atypical behavior over this time interval.

In one embodiment, the system 100 may cause a decreasing of the one or more varying decay rates if the deviation is above a threshold deviation value and traffic speed variance data is below a threshold variance value. In one scenario, the varying decay rates are based on the traffic speed variance data. In one scenario, a road segment at an interval of time may be determined to include a standard deviation of historical information less than a threshold and a decay rate may be determined to include a longer interval for the real-time data (lower strength) with a concomitantly lower reliance on historical information. Thus, the decay is slower and thus includes a greater amount of real-time data.

In one embodiment, the system 100 may include one or more varying decay rates, one or more static baseline values, one or more dynamic values, or a combination thereof for the one or more road segments, one or more time epochs, or a combination thereof. In one scenario, the system 100 may segregate the selected road segments in a variety of ways to include an aggregation of road segments with a subsequent assessment using an aggregation of data from the aggregated road segments. This aggregation may include static baseline decay rates based on average from the plurality of road segment historical information. The road segments may be aggregated based on like characteristics, such as using historical data for a traffic flow, variance information, standard deviation, congestion information, and other like characteristics. In one scenario, the aggregation may include road segments with similar time length intervals or other statistically advantageous groupings. In one scenario, the system 100 may aggregate road segments based on similar traffic flow patterns, which may allow a more efficient analysis and consequently an appropriate decay rate for the aggregated road segments. In another scenario, the system 100 may cause a specification of the one or more dynamic values for the one or more time epochs based on traffic speed variance data. Thus, the system 100 may assess each road segment individually and output a series of decay rates for the individual time intervals based on the individual daily, weekly, monthly, seasonal, yearly, or other time span patterns for each individual road segment based on historical data. Thus, the one or more decay rates are defined for the one or more road segments, one or more groups of the one or more road segments, individual segments of the one or more road segments, or a combination thereof.

In an example use case, the invention aims to solve the problem of individualizing the decay rates by varying decay rates back to historical models instead using of one single rate. By varying the rate at which real-time is "decayed" (the "strength") to the historical models, accuracy may be improved due to changes in how traffic behaves throughout the day (e.g. highly variant traffic periods, congestion, etc.). The value of real-time data is scaled on integrated into the overall algorithm with an appropriate weighted value. Once these values are determined, two solutions may be used. In one embodiment, the first solution is a more simple design that uses different decay rates based upon static times of day, scaled to when most roads tend to experience high/low variant traffic (the decay rates are the same for all roads). For this first solution, testing may be used to identify the best decay strengths for each 15-minute epoch of the day on average for all roads. Upon identifying the best profile on average for all roads, this singular profile of varying strength by time was used as the decay function for all roads (example being that all roads at 9:00 am would decay at the same singular rate, but that rate would be different at 10:00 am). This same profile is then applied to the road segments of interest.

In another embodiment, as an example use case, a more dynamic solution is designed to tailor specific decay profiles for each road. This technique includes automatically identifying the high variance traffic periods for each portion of road instead of the decay strengths being statically defined for all roads. Thus, a standard deviation of historical speed data for each road may be used to scale/vary how quickly the algorithm decays away from real-time data. The algorithm performs more accurately with higher strengths at higher variant times (and lower strengths and lower variant times). Contrary to the first solution, each road may have its own dynamic strength decay function that is fit to an individual road's specific traffic profile instead of using the same static function for every road. By tailoring the function to each road individually the predictions for each road would be catered towards each road specifically and thus achieve greater accuracy (instead of using what is best on average for all roads, the function will be fit to what is best for each road individually).

Figure 8:
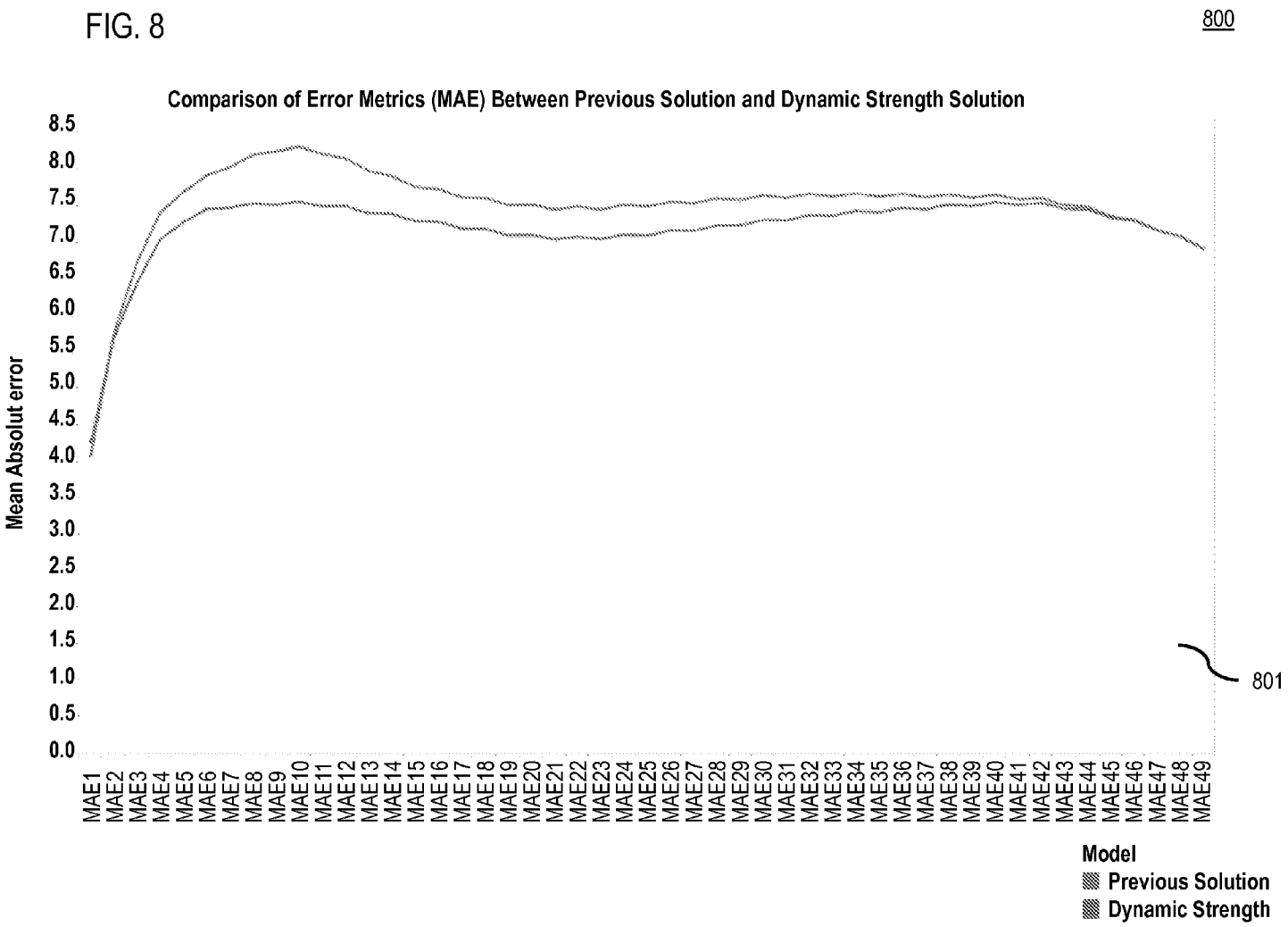
FIG. 8 is a graph diagram that compares static decay profile during static times of day for plurality of road segments to dynamic strength individualized for each road segment, according to various embodiments.

In multiple embodiments, in order to create a dynamic strength decay function fitted to each individual road, the system 100 may use some kind of input that would represent expected variation in each road and scale accordingly. This scaling would make sure the right traffic profile received higher decay strengths (or lower). After testing, it is shown that using historical speed data standard deviation across each day was a reasonable indicator that could be scaled with strength to identify times of the day in which higher decay strengths should be used (and vice versa). Higher strengths correlate with higher variant times as real-time data's value quickly plummets since traffic speeds are changing so rapidly, thus decaying quickly to the model results in better predictions. When real-time data diverts from the expected profile during low variant times, predictions perform better when the algorithm places higher value on real-time for longer as something has clearly caused traffic to deviate from the expected model. An example of a specific road's standard deviation profile for a Monday is shown in FIG. 8. As shown, the peaks in standard deviation correspond on this road to what seems to be a morning and evening congestion. The dynamic strength invention would take these standard deviation values and assign higher strength decay profiles at times when the standard deviation is high (and vice versa) automatically.

As shown in FIG. 1, the system 100 comprises user equipment (UE) 101*a*-101*n* (collectively referred to as UE 101) that may include or be associated with applications 103*a*-103*n* (collectively referred to as applications 103) and sensors 105*a*-105*n* (collectively referred to as sensors 105). In one embodiment, the UE 101 has connectivity to the user interface platform 109 via the communication network 107. In one embodiment, the user interface platform 109 performs the functions associated with a processing of probe trace data to determine one or more modes of transport.

By way of example, the UE 101 is any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, television receiver, radio broadcast receiver, electronic book device, game device, or any combination thereof, including the accessories and peripherals of these devices, or any combination thereof. It is also contemplated that the UE 101 can support any type of interface to the user (such as "wearable" circuitry, etc.).

By way of example, the applications 103 may be any type of application that is executable at the UE 101, such as content provisioning services, location-based service applications, navigation applications, camera/imaging application, media player applications, social networking applications, calendar applications, and the like. In one embodiment, one of the applications 103 at the UE 101 may act as a client for the user interface platform 109 and perform one or more functions of the user interface platform 109. In one scenario, users are able select the particular mode of transport for identification via one or more map applications. In one embodiment, one or more receivers of the UE 101 may process status information associated with one or more points of interest to determine point-of-interest changes and may present point-of-interest representations in a point-of-interest user interface.

By way of example, the sensors 105 may be any type of sensor. In certain embodiments, the sensors 105 may include, for example, a camera/imaging sensor for gathering image data, an audio recorder for gathering audio data, a global positioning sensor for gathering location data, a network detection sensor for detecting wireless signals or network data, temporal information and the like. In one scenario, the sensors 105 may include location sensors (e.g., GPS), light sensors, oriental sensors augmented with height sensor and acceleration sensor, tilt sensors, moisture sensors, pressure sensors, audio sensors (e.g., microphone), or receivers for different short-range communications (e.g., Bluetooth, Wi-Fi, etc.). In one scenario, the one or more sensors 105 may detect attributes for one or more modes of transportation. In another scenario, the one or more UE 101 may have sensors tuned to detect characteristic aggregates of one or more modes of transport, whereby the sensor data may be calculated either on the cloud or by the UE 101

The communication network 107 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

The services platform 113 may include any type of service. By way of example, the services platform 113 may include content (e.g., audio, video, images, etc.) provisioning services, application services, storage services, contextual information determination services, location based services, social networking services, information (e.g., weather, news, etc.) based services, etc. In one embodiment, the services platform 113 may interact with the UE 101, the 3D user interface platform 109 and the content provider 117*a*-117*n* (hereinafter content provider 117) to supplement or aid in the processing of the content information.

By way of example, services 115*a*-115*n* (hereinafter services 115) may be an online service that reflects interests and/or activities of users. In one scenario, the services 115 provide representations of each user (e.g., a profile), his/her social links, and a variety of additional information. The services 115 allow users to share media information, location information, activities information, contextual information, and interests within their individual networks, and provides for data portability.

The content provider 117 may provide content to the UE 101, the user interface platform 109, and the services 115 of the services platform 113. The content provided may be any type of content, such as image content, video content, audio content, textual content, etc. In one embodiment, the content provider 117 may provide content that may supplement content of the applications 103, the sensors 105, the geographic database 111 or a combination thereof. By way of example, the content provider 117 may provide content that may aid in causing a generation of at least one request to capture at least one content presentation. In one embodiment, the content provider 117 may also store content associated with the UE 101, the user interface platform 109, and the services 115 of the services platform 113. In another embodiment, the content provider 117 may manage access to a central repository of data, and offer a consistent, standard interface to data, such as a repository of users' navigational data content.

For example, the geographic database 111 includes node data records 123, road segment or link data records 125, traffic data records 127, and other data records 131. More, fewer or different data records can be provided. In one embodiment, the other data records 131 include cartographic ("carto") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example.

In exemplary embodiments, the road segment data records 125 are links or segments representing roads, streets, or paths, as can be used in the calculated route or recorded route information for causing traffic predictions based, at least in part, on decaying of real-time traffic data to historical traffic data. The node data records 123 are end points corresponding to the respective links or segments of the road segment data records 125. The road link data records 125 and the node data records 123 represent a road network, such as used by vehicles, cars, and/or other entities. Alternatively, the geographic database 111 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 111 can include data about the POIs and their respective locations in the traffic data records 127. The geographic database 111 can also include data about places, such as cities, towns, or other communities, and other geographic features, such as bodies of water, mountain ranges, etc. Such place or feature data can be part of the traffic data 127 or can be associated with traffic data records 127 (such as a data point used for displaying or representing a position of a city). In addition, the geographic database 111 can include and/or be associated with event data (e.g., traffic incidents, constructions, scheduled events, unscheduled events, etc.) associated with the POI data records 147 or other records of the geographic database 111.

The geographic database 111 can be maintained by the content provider (e.g., a map developer) in association with the services platform 113. By way of example, the map developer can collect geographic data to generate and enhance the geographic database 111. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used.

The geographic database 111 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by a UE 101, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

As mentioned above, the server side geographic database 111 can be a master geographic database, but in alternate embodiments, the client side geographic database 111 can represent a compiled navigation database that can be used in or with end user devices (e.g., UEs 101) to provide navigation and/or map-related functions. For example, the geographic database 111 can be used with the end user device 101 to provide an end user with navigation features. In such a case, the geographic database 111 can be downloaded or stored on the end user device UE 101, such as in applications 103, or the end user device UE 101 can access the geographic database 111 through a wireless or wired connection (such as via a server and/or the communication network 107), for example.

In one embodiment, the end user device or UE 101 can be an in-vehicle navigation system, a personal navigation device (PND), a portable navigation device, a cellular telephone, a mobile phone, a personal digital assistant (PDA), a watch, a camera, a computer, and/or other device that can perform navigation-related functions, such as digital routing and map display. In one embodiment, the navigation device UE 101 can be a cellular telephone. An end user can use the device UE 101 for navigation and map functions such as guidance and map display, for example, and for determination of one or more personalized routes or route segments based on one or more calculated and recorded routes, according to exemplary embodiments.

Figure 2:
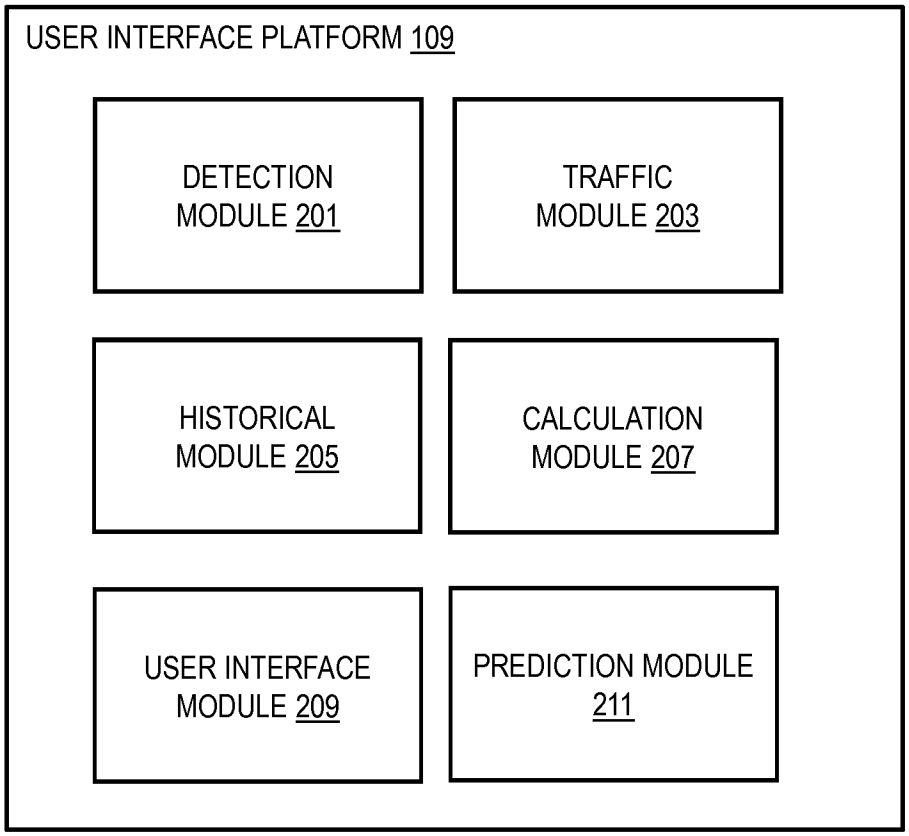
FIG. 2 is a diagram of the components of a user interface platform 109, according to one embodiment.

FIG. 2 is a diagram of the components of a user interface platform 109, according to one embodiment. By way of example, the user interface platform 109 includes one or more components for determining one or more varying decay rates associated with one or more road segments and causing a decaying of real-time traffic data to historical traffic data associated with the one or more road segments based, at least in part, on the one or more varying decay rates. It is contemplated that the functions of these components may be combined in one or more components or performed by other components of equivalent functionality. In one embodiment, the user interface platform 109 includes a detection module 201, a traffic module 203, a historical module 205, a calculation module 207, a user interface module 209, and a prediction module 211.

In one embodiment, the detection module 201 includes system algorithms, sensors 105, network databases, and/or one or more third-party content providers, such as content providers 117 for determining one or more varying decay rates associated with one or more road segments. The mapping and/or detection data can be preprogrammed into the user interface platform 109, gathered from crowd source data network, or gathered from at least one sensor or device, and processed via the traffic module 203 and historical module 205 to provide a decaying of real-time traffic data to historical traffic data associated with the one or more road segments based, at least in part, on the one or more varying decay rates. This detection module 201 may be further modified with user preferences and tolerances, which, in part, provide a determination of traffic flow information.

In one embodiment, the traffic module 203 includes an integrated system for a processing of traffic flow data and mapping data including real-time and historical data to determine one or more varying decay rates associated with one or more road segments. Such traffic information can be stored in an on-board systems database, modified manually, accessed when prompted by application 103, or gathered from devices or sensors incorporated into the detection module 201. Such may be processed via the traffic module 203 to provide an output for the decaying of real-time traffic data to historical traffic data associated with the one or more road segments based, at least in part, on the one or more varying decay rates. The traffic module 203 may also be used to correlate mapping, and other relevant information with the traffic flow data. This traffic information may be further modified with user preferences and tolerances, which, in part, provide selective modifications of the traffic determination system.

In multiple embodiments, the historical module 205 provides traffic flow data that has been accumulated over a relevant time period for one or more road segments. This historical module 205 may make predictions over the next 12 hours or for another specified time period. The historical module 205 can be integrated to extract data from multiple sources including: traffic flow data, mapping data, crowd source data, data from networks or databases, weather reports, and real-time information from sensors/detectors via the detection module 201. Furthermore, integration can provide a calculation for the past travel characteristics which may be continually extracted from traffic flow information including information processed via the traffic module 203. It may include an output as to the varying decay rate information based on statistical models constructed from the historical data.

In multiple embodiments, the calculation module 207 will process the outputted information of the detection module 201, traffic module 203, and historical module 205, respectively. The detection module 201 and traffic module 203 configure the real-time traffic flow data. Therefore, the user interface platform 109 includes a calculation module 207 to evaluate the detection module 201 and traffic module 203 with the historical module and integrate the information to determine a number of statistical parameters, such as traffic flow variance, standard deviation and the like. Furthermore, inputted data, algorithms, and process formats may be used to calculate one or more varying decay rates associated with one or more road segments to cause a decaying of real-time traffic data to historical traffic data based on the varying decay rate. This integrated real-time and historical traffic flow data may be analyzed and outputted to the prediction module 211 to determine traffic predictions based on the decaying of the real-time traffic data to the historical traffic data.

In one embodiment, the user interface module 209 may be configured for exchanging information between UE 101 and the geographic database 111, and/or one or more third-party content providers. In another embodiment, the user interface module 209 enables presentation of a graphical user interface (GUI) for displaying predictive traffic information. For example, the user interface module 209 executes a GUI application configured to provide users with a processing of traffic information and a presentation of forecasts (e.g. 12 hr. forecasts). The user interface module 209 employs various application programming interfaces (APIs) or other function calls corresponding to the applications 103 of UE 101, thus enabling the display of graphics primitives such as menus, buttons, data entry fields, etc., for generating the user interface elements. Still further, the user interface module 209 may be configured to operate in connection with augmented reality (AR) processing techniques, wherein various different applications, graphic elements and features may interact. For example, the user interface module 209 may coordinate the presentation of augmented reality map images in conjunction with content information for a given location or in response to a selected point-of-interest representation. In a further embodiment, the user interface module 209 may cause a presentation of traffic flow information as representations, as photographic images, or a combination thereof.

In one embodiment, the prediction module 211 may process the outputs of the calculation module 207 as well as information from other modules to determine traffic predictions based on the decaying of the real-time traffic data to the historical traffic data. For instance, the prediction module 211 may output a statistical model of the predicted traffic flow over the next day, week, month, etc. These predictions may be constructed based on the average of a plurality of road segments or constructed for individual road segments. In one scenario, the prediction module 211 may provide feedback iteratively to the traffic module 203, calculation module 207 or one of the other modules. In another embodiment, the prediction module 211 may cause a presentation of content information in the most suitable manner for a consistent user experience.

Figure 3:
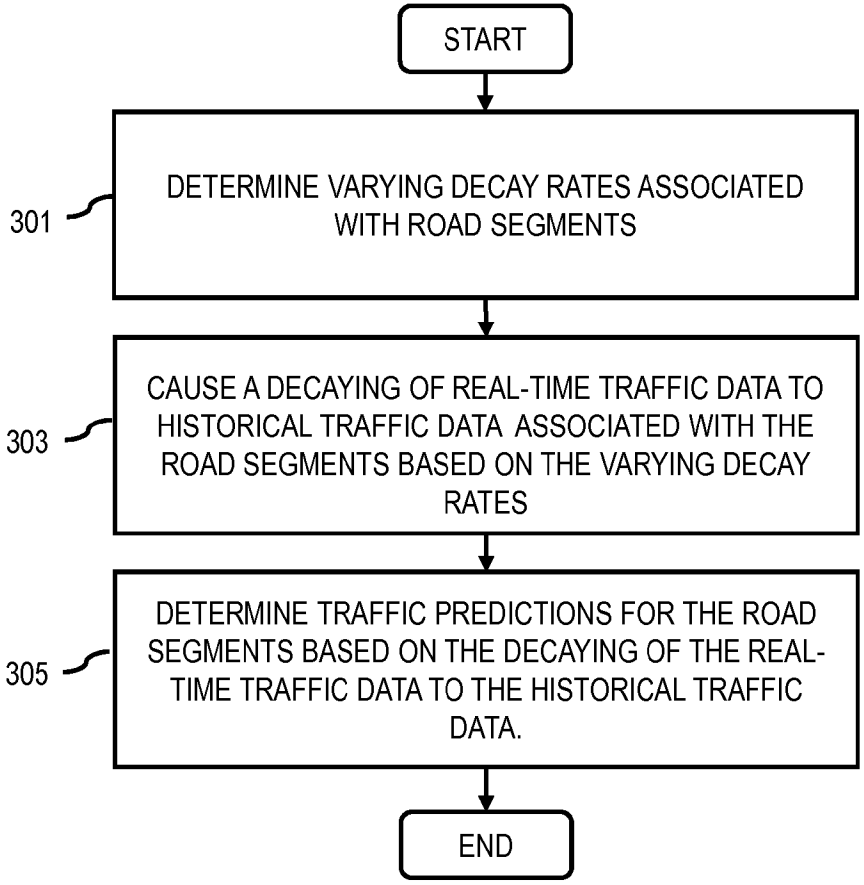
FIG. 3 is a flowchart of a process for determining varying decay rates associated with road segments, and then decaying the real-time traffic data to the historical traffic data, according to one embodiment.
Figure 10:
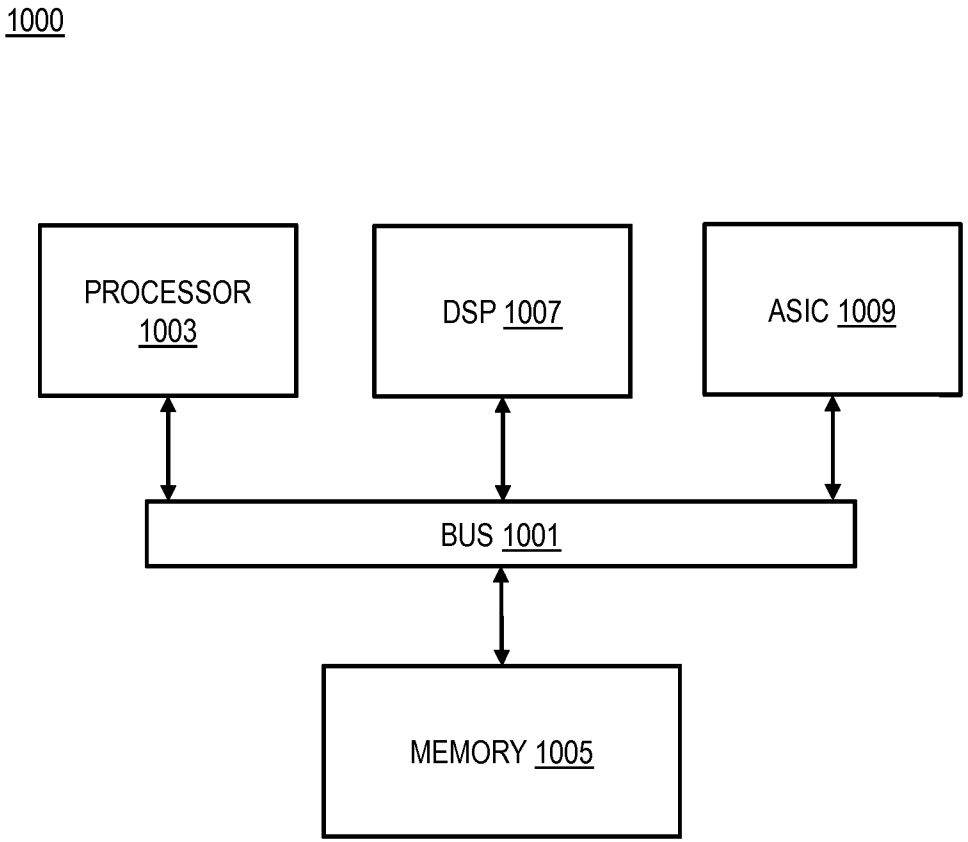
FIG. 10 is a diagram of a chip set that can be used to implement an embodiment of the invention.

FIG. 3 is a flowchart of a process for determining varying decay rates associated with road segments, and then decaying the real-time traffic data to the historical traffic data, according to one embodiment. In one embodiment, the user interface platform performs the process 300 and is implemented in, for instance, a chip set including a processor and a memory as shown in FIG. 10.

In step 301, the user interface platform 109 may determine decay rates associated with one or more road segments. In multiple embodiments, as discussed, a decay includes starting with pure real-time (which is decayed) information, then progressively decaying the proportion of real-time information as the proportion of historical information increases to 100%. In one scenario, the decay rate may be targeted for a selected or derived proportion of real-time to historical information for an improved accuracy. Thus, for traffic data of high variance, such as for periods of high traffic with considerable traffic congestion, the decay rate may plummet and thus produce a greater reliance on historical information. In another scenario, conversely, for traffic data of low variance, such as for periods of low traffic with little traffic congestion, the decay rate may be slower (low strength) and thus produce a greater reliance on real-time information. In one embodiment, the one or more decay rates are defined for all of the one or more road segments, one or more groups of the one or more road segments, individual ones of the one or more road segments, or a combination thereof. In one scenario, the user interface platform 109 may segregate the selected road segments in a variety of ways to include an aggregation of road segments with a subsequent assessment using an aggregation of data from the aggregated road segments. This is used to construct a time series of decay rates of an identical pattern for all of a plurality of road segments or a designated grouping based on one or more characteristics. In another scenario, the decay rates may be individually calibrated for each road segment.

In step 303, the user interface platform 109 may cause, at least in part, a decaying of real-time traffic data to historical traffic data associated with the one or more road segments based on the one or more varying decay rates. In multiple embodiments, the user interface platform 109 may use the determined decay rates such that the decaying of real-time information to historical traffic data using the determined varying decay rates for the respective road segments. This decay begins with 100% real-time information and 0% historic information, and then progressively moves to the inverse (100% historic, 0% real-time). In one scenario, the function may be continuous, discontinuous, linear, logarithmic, or other function, which generates the targeted representation. In addition, the decay rate (real-time to historic) may be aggregated from a plurality of road segment to yield a static predictive function for these road segments. In another scenario, the predictive information may be tailored to each particular road segment. Thus, a statistical function using these elements can provide a more nuanced and accurate determination of the traffic flow.

In step 305, the user interface platform 109 may determine one or more traffic predictions for the one or more road segments based on the decaying of the real-time traffic data to the historical traffic data. In one embodiment, the user interface platform 109 may use the determined decay rate for the respective road segments to produce one or more decay functions rate functions that are either applied to an aggregate of road segments or individualized to the characteristics of a particular road segment. In multiple embodiments, the individualization of the decay function for a particular road segment may include a determination of a decay rate based on variance information, including the standard deviation from one or more sets of historic data. Thus, the decay rate may be of a greater "strength" to include a greater reliance on historic information (such as for congestion) or lower strength for a greater reliance on real-time information (such as for non-congestion intervals of time). In one scenario, once the respective decay rates are determined for temporal intervals of the road segments, one or more traffic predictions may be determined for each road interval for one or more periods of time.

Figure 4:
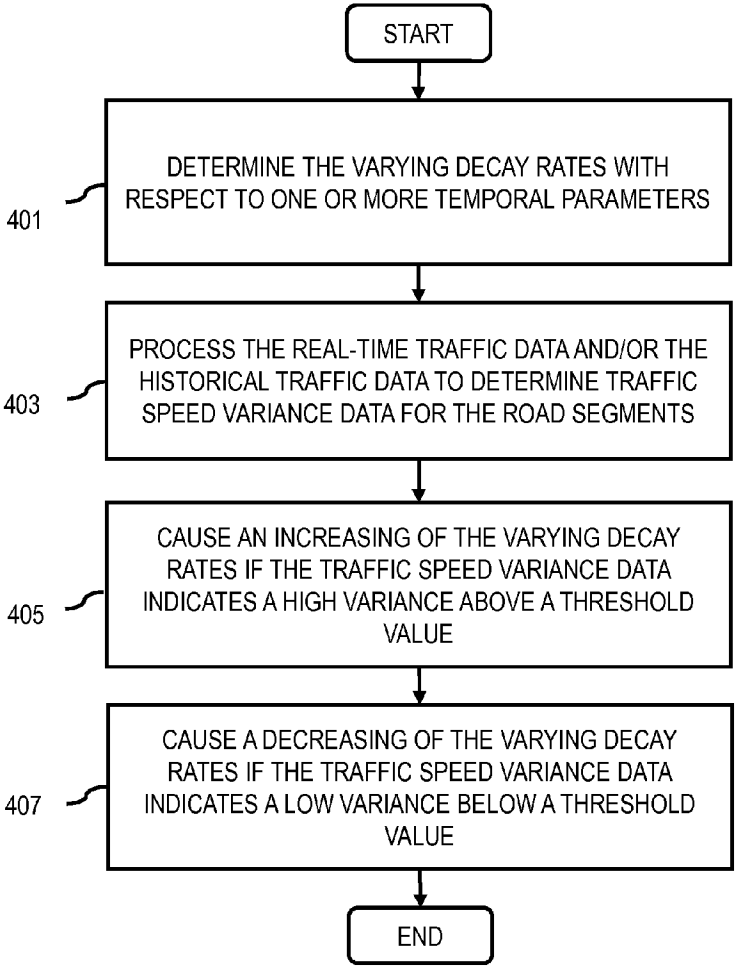
FIG. 4 is a flowchart of a process for causing an increase or a decrease of the varying decay rates based on a threshold value, according to one embodiment.

FIG. 4 is a flowchart of a process for causing an increase or a decrease of the varying decay rates based on a threshold value, according to one embodiment. In one embodiment, the user interface platform 109 performs the process 400 and is implemented in, for instance, a chip set including a processor and a memory as shown in FIG. 10.

In step 401, the user interface platform 109 may determine the one or more varying decay rates with respect to one or more temporal parameters. The one or more different rates of the one or more varying decay rates are based, at least in part, on the one or more temporal parameters. In one embodiment, the user interface platform 109 determines a decay rate for a particular road segment for a determined length of time. In one scenario, the time interval may be selected to optimally capture the particular traffic behavior to determine one or more decay rates. In one embodiment, temporal parameters may be chosen to include a particular decay rate function that best represents the traffic information over a specified time period. Furthermore, the time intervals may cover select time periods including a day, week, month, season, year, or a combination thereof. In one scenario, once the respective decay rates are determined for temporal intervals of the road segments, one or more traffic predictions may be determined for each road interval for one or more periods of time. In another embodiment, the one or more temporal parameters include, at least in part, a time of day, a day of week, a month of year, a season, or a combination thereof.

In step 403, the user interface platform 109 may process and/or facilitate a processing of the real-time traffic data, the historical traffic data, or a combination thereof to determine traffic speed variance data for the one or more road segments. In one embodiment, the user interface platform 109 via the historical module 205 may determine historical variance data over a specified time period. In one scenario, the historical data may be assessed for a standard deviation over time to determine whether the degree of variance indicates a high or low strength for the one or more decay rates. In another embodiment, the user interface platform 109 may process the one or more varying decay rates based on speed variance data. In one embodiment, the varying decay rates are based on an assessment of the traffic speed variance data using historical information via the historical module 205. In multiple embodiments, user interface platform 109 may cause an increasing of the one or more varying decay rates if the traffic speed variance data indicates a high variance above a threshold value. And, simultaneous causing for other intervals, a decreasing of the one or more varying decay rates if the traffic speed variance data indicates a low variance below a threshold value.

In step 405, the user interface platform 109 may cause an increasing of the one or more varying decay rates if the traffic speed variance data indicates a high variance above a threshold value. In one embodiment, a road segment at a select interval of time may be determined to include a standard deviation of historical information greater than a threshold. In one scenario, high variance may indicate that the said road segment experienced congestion over this time period due to the variances in traffic flow. In one scenario, the decay rate may be determined to include greater strength and include a plummeting of the real-time data with a concomitantly greater reliance on historical information.

In step 407, the user interface platform 109 may cause a decreasing of the one or more varying decay rates if the traffic speed variance data indicates a low variance below a threshold value. In one embodiment, a road segment at an interval of time may be determined to include a standard deviation of historical information less than a threshold. This may indicate that the said road segment experienced low congestion over this time period due to the low variances in traffic flow. Thus, a decay rate may be determined to include lower strength and include a longer interval for the real-time data with a concomitantly lower reliance on historical information.

Figure 5:
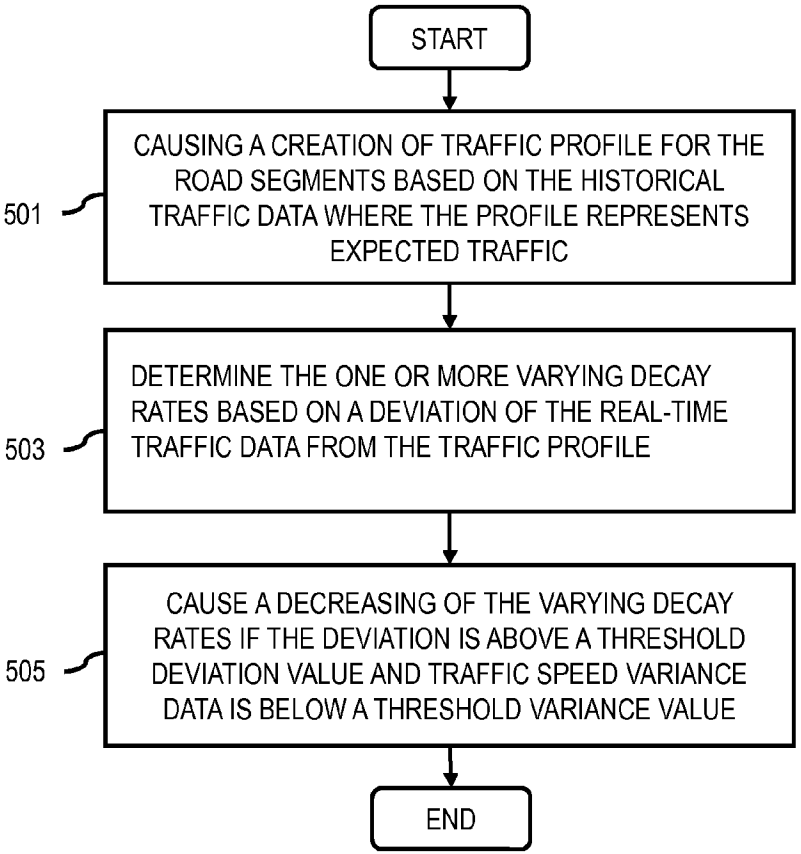
FIG. 5 is a flowchart of a process for creating traffic profiles, determining the varying decay rates, and causing a decreasing of the varying decay rates, according to one embodiment.

FIG. 5 is a flowchart of a process for creating traffic profiles, determining the varying decay rates, and causing a decreasing of the varying decay rates, according to one embodiment. In one embodiment, the user interface platform 109 performs the process 500 and is implemented in, for instance, a chip set including a processor and a memory as shown in FIG. 10.

In step 501, the user interface platform 109 may cause a creation of a traffic profile for one or more road segments based, at least in part, on the historical traffic data, wherein the traffic profile represents expected traffic data for the one or more road segments. In one scenario, the system 100 may use historical traffic data for one or more road segments. In one scenario, this historical traffic data may be analyzed to determine the statistical characteristics for each road segment over time. In multiple scenarios, the statistical characteristics may be analyzed for intervals of time over the total time interval to determine high congestion periods, lower congestion periods, and other like characteristics. Thus, a statistical data set that includes a variance greater than a threshold, such that the standard deviation is greater than a threshold may be deemed high congestion.

In step 503, the user interface platform 109 may determine the varying decay rates based on a determination of deviations of the real-time traffic data from the at least one traffic profile. In one embodiment, the system 100 may include time intervals of low variance, such that a standard deviation is less than a threshold. This may be deemed to be a low congestion area. In one scenario, the system 100 may determine that a low variance time interval includes a deviation from normal behavior including the variance behavior. In such situations, the system 100 may place a greater reliance on real-time data to capture the atypical behavior over this time interval.

In step 505, the user interface platform 109 may cause a decreasing of the one or more varying decay rates if the deviation is above a threshold deviation value and traffic speed variance data is below a threshold variance value. In one embodiment, the varying decay rates are based on the traffic speed variance data. In one scenario, a road segment at an interval of time may be determined to include a standard deviation of historical information less than a threshold and furthermore the deviation in the real-time data may be greater than a threshold value. Thus, a decay rate may be determined to include a longer interval for the real-time data (lower strength) to capture such real-time data of uncharacteristic variance, such that there is a concomitantly lower reliance on historical information. Thus, the decay is slower and includes a greater proportion of real-time data.

Figure 6:
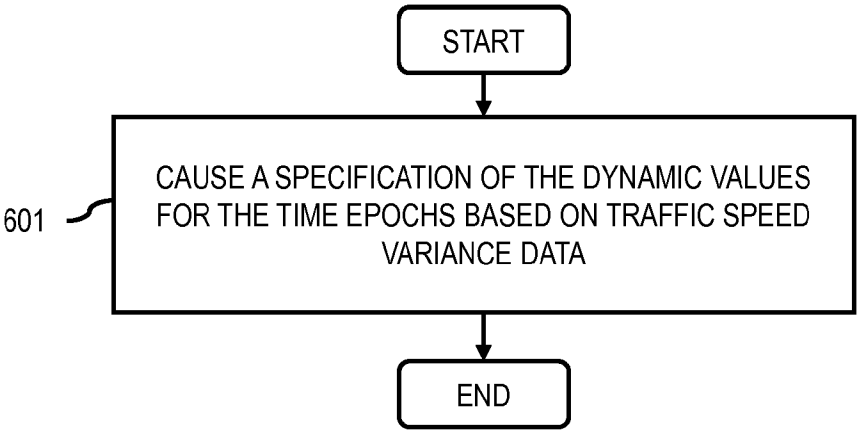
FIG. 6 is a flowchart of a process for causing a specification of the dynamic, according to one embodiment.

FIG. 6 is a flowchart of a process for causing a specification of the dynamic, according to one embodiment. In one embodiment, the user interface platform 109 performs the process 600 and is implemented in, for instance, a chip set including a processor and a memory as shown in FIG. 10.

In step 601, the user interface platform 109 may cause a specification of the one or more dynamic values for the one or more time epochs based on traffic speed variance data. In one embodiment, the user interface platform 109 may assess each road segment individually and output a series of decay rates for the individual time intervals based on the individual daily, weekly, monthly, seasonal, yearly, or other time span patterns for each individual road segment based on historical data. In one scenario, the decay rates may include a high strength (decay) option or a low strength (decay) option for each time epoch depending on the historical variance calculation. In another scenario, the decay rates may be individually calibrated for each time epoch, such that a range of options may be included between very high strength and very low strength. These decay rate may follow a chosen function, such that linear, exponential, or other related statistical function that may be applicable for either a grouping of road segments at one or more time epochs or individual road segments at one or more time epochs. In one embodiment, the user interface platform 109 may include one or more varying decay rates, one or more static baseline values, one or more dynamic values, or a combination thereof for the one or more road segments, one or more time epochs, or a combination thereof. In one embodiment, one or more decays rates may include static baseline decay rates based on one or more averages from the historical information of a plurality of road segments. In one embodiment, the road segments may be aggregated based on like characteristics, such as by using historical data for: a traffic flow, variance information, standard deviation, congestion information, and other like characteristics. Thus, each grouping of road segments may include a statically defined series of decay rates, which may include a decay rate profile over a day, week, month, year, etc. In one scenario, the user interface platform 109 may aggregate road segments based on similar traffic flow patterns, which may allow a more efficient analysis and consequently an appropriate decay rate for the aggregated road segments. In one scenario, the aggregation may include road segments with similar time length intervals or other statistically advantageous groupings. In one scenario, the decay rate may be chosen to include a few statically defined options for each time epoch (15 min. or other time intervals for decay), such that a decay rate interval may include such options as "high strength" or "low strength" decay based on the level of variance or standard deviation analysis in the historical information. In another embodiment, the decay rate may include dynamic values appropriate to individual road segments, such that each segment may include an individualized profile based on historical data of the individual road segment. In another embodiment, the decay rate may be chosen to include a dynamic options for each time epoch in which the rate may include many gradations between high strength (reliance on historical information) and low (strength). Such options may include statistical functions designed for the purpose of capturing traffic flow information.

Figure 7:
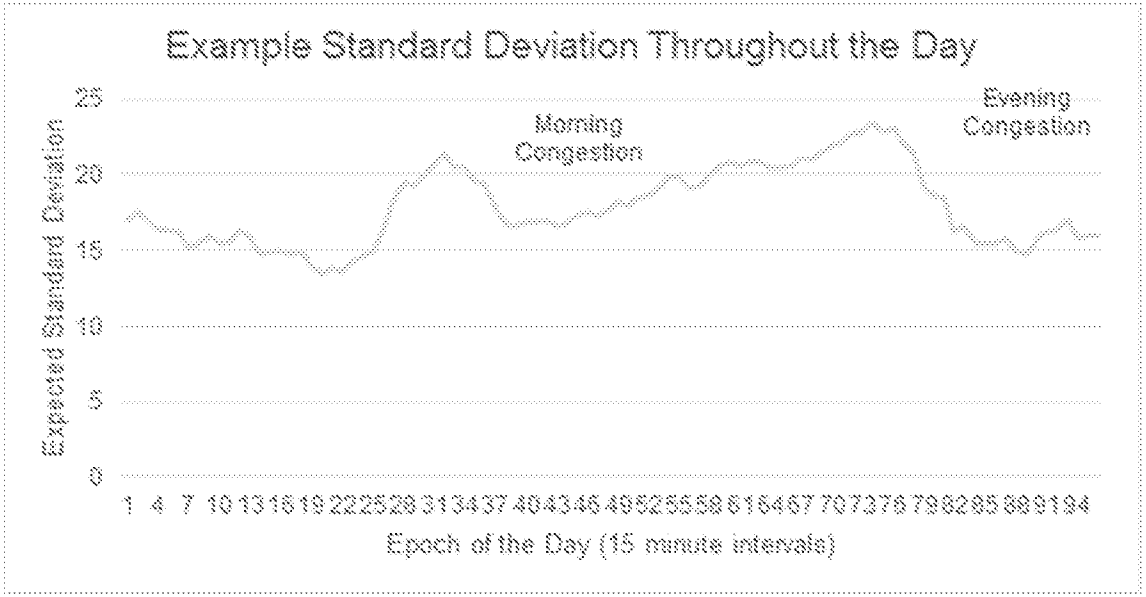
FIG. 7 is a graph diagram that represents historical information including an assessment of the variance (e.g., standard deviation graphed throughout the day), according to various embodiments.

FIG. 7 is a graph diagram that represents historical information including an assessment of the variance (e.g., standard deviation graphed throughout the day), according to various embodiments. In one scenario, for each road and day, a combination of the minimum or maximum standard deviation values are mapped and scaled to the strength range values. Intermediate standard deviation values are then distributed between this spectrum to allow for a continuous curve of strength decay profiles depending on the specific road standard deviation profile. This allows to dynamically vary strengths based on each specific road's expected standard deviation profile (where higher expected standard deviation indicates traffic speeds tend to be more variant) for each day of the week. Each road's ideal strength decay profile can vary greatly and this solution caters to maximizing performance and/or accuracy by trying to automatically optimize the strength decay profile for each individual road (on each day).

FIG. 8 is a graph diagram that compares static decay profile during static times of day for plurality of road segments to dynamic strength individualized for each road segment, according to various embodiments. In one embodiment, the error metrics used by the Predictive Traffic (e.g., Mean Absolute Error—average expected speed off of the true speed) showed a decrease in the expected error (depending on the market and the time of the day error was reduced by 5-20%). An example market 801 is shown in FIG. 8 with a version of the Predictive product without Dynamic Strength (Previous Solution) and the Predictive Application with the invention (Dynamic Strength). In the case of this figure, it is showing expected error (MAE) which means that the lower the curve, the more accurate the predictions of that product on average (the X-axis are predictions going forward to 12 hours). Through extensive testing on varying markets dynamic strength showed an improvement that was statistically significant for predictive performance/accuracy.

One method (described previously) was to use static decay strengths for all roads based on expected times of day where most roads experience high variance (e.g., 6 a.m.-10 a.m. and 4 p.m.-8 p.m.). The dynamic solutions gives far better results as the decay functions were optimized towards each individual road instead of treating all roads the same. Thus, the predictive algorithm can identify congestion periods (and other expected high variant traffic periods) structure for each individual road and react appropriately (the previous static times as a "one size fits all" solution is more error prone because it is generalized). The advantage of the dynamic solution includes more accurate predictions for road segments with high levels of congestion and other dynamic features. In addition, this method allows for the algorithm to automatically handle and identify the expected highly variant periods and remove the necessity for manual tuning/tweaking. As the predictive program receives more data and refits the historical models, the system will adjust itself with the new data and adjust accordingly to the new data.

The processes described herein for causing traffic predictions based, at least in part, on decaying of real-time traffic data to historical traffic data may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

Figure 9:
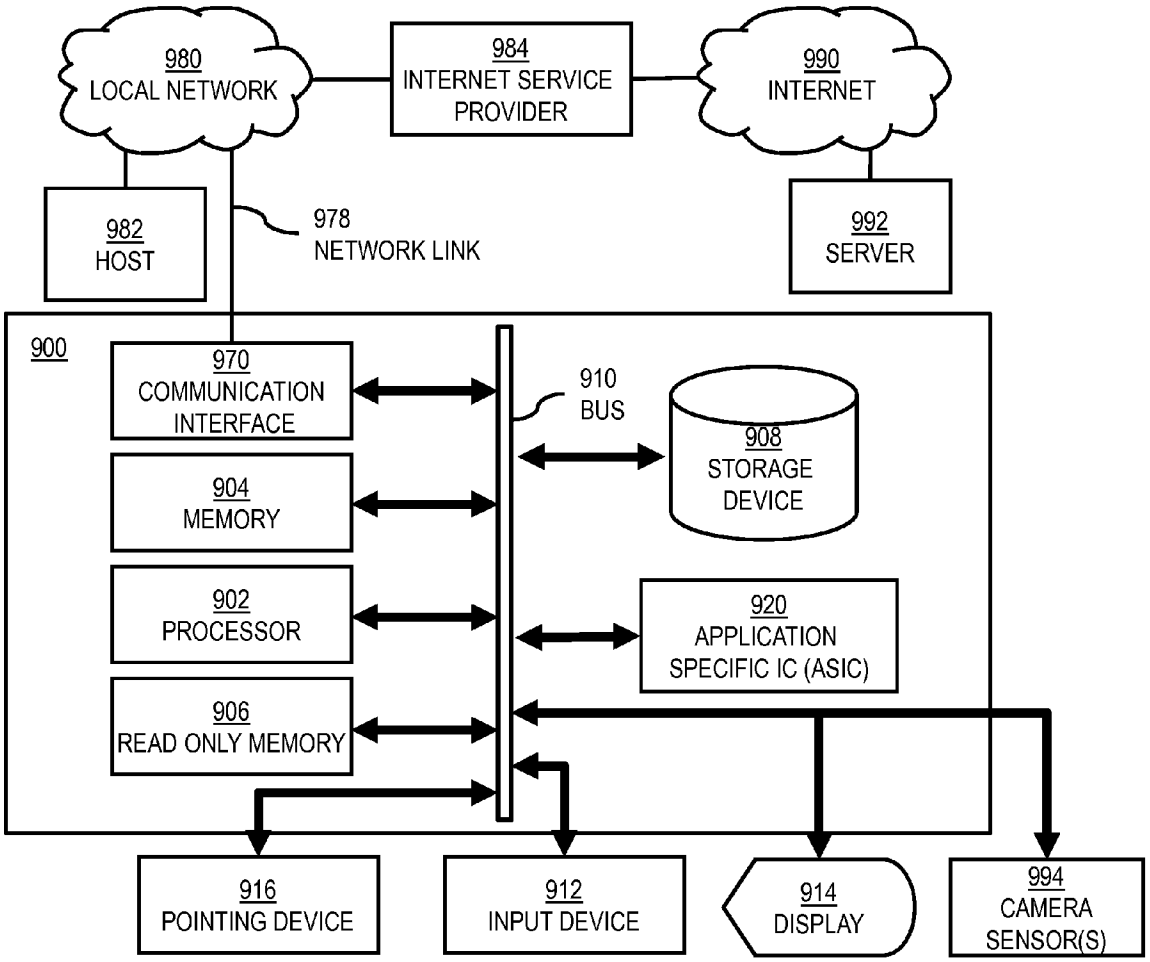
FIG. 9 is a diagram of hardware that can be used to implement an embodiment of the invention.

FIG. 9 illustrates a computer system 900 upon which an embodiment of the invention may be implemented. Although computer system 900 is depicted with respect to a particular device or equipment, it is contemplated that other devices or equipment (e.g., network elements, servers, etc.) within FIG. 9 can deploy the illustrated hardware and components of system 900. Computer system 900 is programmed (e.g., via computer program code or instructions) to cause traffic predictions based, at least in part, on decaying of real-time traffic data to historical traffic data as described herein and includes a communication mechanism such as a bus 910 for passing information between other internal and external components of the computer system 900. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range. Computer system 900, or a portion thereof, constitutes a means for performing one or more steps of causing traffic predictions based, at least in part, on decaying of real-time traffic data to historical traffic data.

A bus 910 includes one or more parallel conductors of information so that information is transferred quickly among devices coupled to the bus 910. One or more processors 902 for processing information are coupled with the bus 910.

A processor (or multiple processors) 902 performs a set of operations on information as specified by computer program code related to cause traffic predictions based, at least in part, on decaying of real-time traffic data to historical traffic data. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 910 and placing information on the bus 910. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 902, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 900 also includes a memory 904 coupled to bus 910. The memory 904, such as a random access memory (RAM) or any other dynamic storage device, stores information including processor instructions for causing traffic predictions based, at least in part, on decaying of real-time traffic data to historical traffic data. Dynamic memory allows information stored therein to be changed by the computer system 900. RAM allows a unit of information stored at a location called a memory address to be stored and retrieved independently of information at neighboring addresses. The memory 904 is also used by the processor 902 to store temporary values during execution of processor instructions. The computer system 900 also includes a read only memory (ROM) 906 or any other static storage device coupled to the bus 910 for storing static information, including instructions, that is not changed by the computer system 900. Some memory is composed of volatile storage that loses the information stored thereon when power is lost. Also coupled to bus 910 is a non-volatile (persistent) storage device 908, such as a magnetic disk, optical disk or flash card, for storing information, including instructions, that persists even when the computer system 900 is turned off or otherwise loses power.

Information, including instructions for causing traffic predictions based, at least in part, on decaying of real-time traffic data to historical traffic data, is provided to the bus 910 for use by the processor from an external input device 912, such as a keyboard containing alphanumeric keys operated by a human user, or a sensor. A sensor detects conditions in its vicinity and transforms those detections into physical expression compatible with the measurable phenomenon used to represent information in computer system 900. Other external devices coupled to bus 910, used primarily for interacting with humans, include a display device 914, such as a cathode ray tube (CRT), a liquid crystal display (LCD), a light emitting diode (LED) display, an organic LED (OLED) display, a plasma screen, or a printer for presenting text or images, and a pointing device 916, such as a mouse, a trackball, cursor direction keys, or a motion sensor, for controlling a position of a small cursor image presented on the display 914 and issuing commands associated with graphical elements presented on the display 914, and one or more camera sensors 994 for capturing, recording and causing to store one or more still and/or moving images (e.g., videos, movies, etc.) which also may comprise audio recordings. In some embodiments, for example, in embodiments in which the computer system 900 performs all functions automatically without human input, one or more of external input device 912, display device 914 and pointing device 916 may be omitted.

In the illustrated embodiment, special purpose hardware, such as an application specific integrated circuit (ASIC) 920, is coupled to bus 910. The special purpose hardware is configured to perform operations not performed by processor 902 quickly enough for special purposes. Examples of ASICs include graphics accelerator cards for generating images for display 914, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 900 also includes one or more instances of a communications interface 970 coupled to bus 910. Communication interface 970 provides a one-way or two-way communication coupling to a variety of external devices that operate with their own processors, such as printers, scanners and external disks. In general the coupling is with a network link 978 that is connected to a local network 980 to which a variety of external devices with their own processors are connected. For example, communication interface 970 may be a parallel port or a serial port or a universal serial bus (USB) port on a personal computer. In some embodiments, communications interface 970 is an integrated services digital network (ISDN) card or a digital subscriber line (DSL) card or a telephone modem that provides an information communication connection to a corresponding type of telephone line. In some embodiments, a communication interface 970 is a cable modem that converts signals on bus 910 into signals for a communication connection over a coaxial cable or into optical signals for a communication connection over a fiber optic cable. As another example, communications interface 970 may be a local area network (LAN) card to provide a data communication connection to a compatible LAN, such as Ethernet. Wireless links may also be implemented. For wireless links, the communications interface 970 sends or receives or both sends and receives electrical, acoustic or electromagnetic signals, including infrared and optical signals, that carry information streams, such as digital data. For example, in wireless handheld devices, such as mobile telephones like cell phones, the communications interface 970 includes a radio band electromagnetic transmitter and receiver called a radio transceiver. In certain embodiments, the communications interface 970 enables connection to the communication network 107 for causing traffic predictions based, at least in part, on decaying of real-time traffic data to historical traffic data to the UE 101.

The term "computer-readable medium" as used herein refers to any medium that participates in providing information to processor 902, including instructions for execution. Such a medium may take many forms, including, but not limited to computer-readable storage medium (e.g., non-volatile media, volatile media), and transmission media. Non-transitory media, such as non-volatile media, include, for example, optical or magnetic disks, such as storage device 908. Volatile media include, for example, dynamic memory 904. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

Logic encoded in one or more tangible media includes one or both of processor instructions on a computer-readable storage media and special purpose hardware, such as ASIC 920.

Network link 978 typically provides information communication using transmission media through one or more networks to other devices that use or process the information. For example, network link 978 may provide a connection through local network 980 to a host computer 982 or to equipment 984 operated by an Internet Service Provider (ISP). ISP equipment 984 in turn provides data communication services through the public, world-wide packet-switching communication network of networks now commonly referred to as the Internet 990.

A computer called a server host 992 connected to the Internet hosts a process that provides a service in response to information received over the Internet. For example, server host 992 hosts a process that provides information representing video data for presentation at display 914. It is contemplated that the components of system 900 can be deployed in various configurations within other computer systems, e.g., host 982 and server 992.

At least some embodiments of the invention are related to the use of computer system 900 for implementing some or all of the techniques described herein. According to one embodiment of the invention, those techniques are performed by computer system 900 in response to processor 902 executing one or more sequences of one or more processor instructions contained in memory 904. Such instructions, also called computer instructions, software and program code, may be read into memory 904 from another computer-readable medium such as storage device 908 or network link 978. Execution of the sequences of instructions contained in memory 904 causes processor 902 to perform one or more of the method steps described herein. In alternative embodiments, hardware, such as ASIC 920, may be used in place of or in combination with software to implement the invention. Thus, embodiments of the invention are not limited to any specific combination of hardware and software, unless otherwise explicitly stated herein.

The signals transmitted over network link 978 and other networks through communications interface 970, carry information to and from computer system 900. Computer system 900 can send and receive information, including program code, through the networks 980, 990 among others, through network link 978 and communications interface 970. In an example using the Internet 990, a server host 992 transmits program code for a particular application, requested by a message sent from computer 900, through Internet 990, ISP equipment 984, local network 980 and communications interface 970. The received code may be executed by processor 902 as it is received, or may be stored in memory 904 or in storage device 908 or any other non-volatile storage for later execution, or both. In this manner, computer system 900 may obtain application program code in the form of signals on a carrier wave.

Various forms of computer readable media may be involved in carrying one or more sequence of instructions or data or both to processor 902 for execution. For example, instructions and data may initially be carried on a magnetic disk of a remote computer such as host 982. The remote computer loads the instructions and data into its dynamic memory and sends the instructions and data over a telephone line using a modem. A modem local to the computer system 900 receives the instructions and data on a telephone line and uses an infra-red transmitter to convert the instructions and data to a signal on an infra-red carrier wave serving as the network link 978. An infrared detector serving as communications interface 970 receives the instructions and data carried in the infrared signal and places information representing the instructions and data onto bus 910. Bus 910 carries the information to memory 904 from which processor 902 retrieves and executes the instructions using some of the data sent with the instructions. The instructions and data received in memory 904 may optionally be stored on storage device 908, either before or after execution by the processor 902.

FIG. 10 illustrates a chip set or chip 1000 upon which an embodiment of the invention may be implemented. Chip set 1000 is programmed to cause traffic predictions based, at least in part, on decaying of real-time traffic data to historical traffic data as described herein and includes, for instance, the processor and memory components described with respect to FIG. 9 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 1000 can be implemented in a single chip. It is further contemplated that in certain embodiments the chip set or chip 1000 can be implemented as a single "system on a chip." It is further contemplated that in certain embodiments a separate ASIC would not be used, for example, and that all relevant functions as disclosed herein would be performed by a processor or processors. Chip set or chip 1000, or a portion thereof, constitutes a means for performing one or more steps of providing user interface navigation information associated with the availability of functions. Chip set or chip 1000, or a portion thereof, constitutes a means for performing one or more steps of causing traffic predictions based, at least in part, on decaying of real-time traffic data to historical traffic data.

In one embodiment, the chip set or chip 1000 includes a communication mechanism such as a bus 1001 for passing information among the components of the chip set 1000. A processor 1003 has connectivity to the bus 1001 to execute instructions and process information stored in, for example, a memory 1005. The processor 1003 may include one or more processing cores with each core configured to perform independently. A multi-core processor enables multiprocessing within a single physical package. Examples of a multi-core processor include two, four, eight, or greater numbers of processing cores. Alternatively or in addition, the processor 1003 may include one or more microprocessors configured in tandem via the bus 1001 to enable independent execution of instructions, pipelining, and multithreading. The processor 1003 may also be accompanied with one or more specialized components to perform certain processing functions and tasks such as one or more digital signal processors (DSP) 1007, or one or more application-specific integrated circuits (ASIC) 1009. A DSP 1007 typically is configured to process real-world signals (e.g., sound) in real time independently of the processor 1003. Similarly, an ASIC 1009 can be configured to performed specialized functions not easily performed by a more general purpose processor. Other specialized components to aid in performing the inventive functions described herein may include one or more field programmable gate arrays (FPGA) (not shown), one or more controllers (not shown), or one or more other special-purpose computer chips.

In one embodiment, the chip set or chip 1000 includes merely one or more processors and some software and/or firmware supporting and/or relating to and/or for the one or more processors.

The processor 1003 and accompanying components have connectivity to the memory 1005 via the bus 1001. The memory 1005 includes both dynamic memory (e.g., RAM, magnetic disk, writable optical disk, etc.) and static memory (e.g., ROM, CD-ROM, etc.) for storing executable instructions that when executed perform the inventive steps described herein to causing traffic predictions based, at least in part, on decaying of real-time traffic data to historical traffic data. The memory 1005 also stores the data associated with or generated by the execution of the inventive steps.

Figure 11:
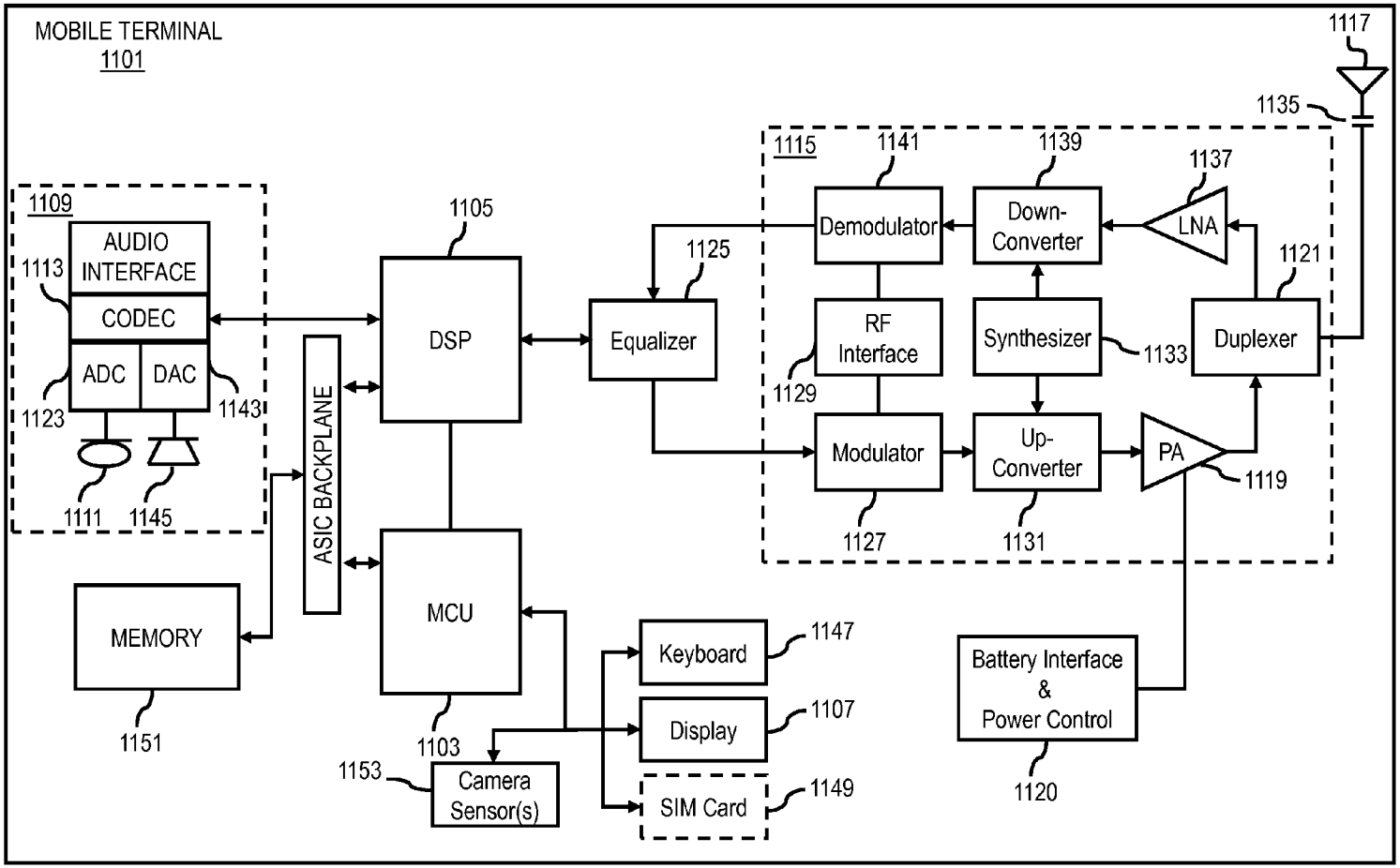
FIG. 11 is a diagram of a mobile terminal (e.g., handset) that can be used to implement an embodiment of the invention.

FIG. 11 is a diagram of exemplary components of a mobile terminal (e.g., handset) for communications, which is capable of operating in the system of FIG. 1, according to one embodiment. In some embodiments, mobile terminal 1101, or a portion thereof, constitutes a means for performing one or more steps of causing traffic predictions based, at least in part, on decaying of real-time traffic data to historical traffic data. Generally, a radio receiver is often defined in terms of front-end and back-end characteristics. The front-end of the receiver encompasses all of the Radio Frequency (RF) circuitry whereas the back-end encompasses all of the base-band processing circuitry. As used in this application, the term "circuitry" refers to both: (1) hardware-only implementations (such as implementations in only analog and/or digital circuitry), and (2) to combinations of circuitry and software (and/or firmware) (such as, if applicable to the particular context, to a combination of processor(s), including digital signal processor(s), software, and memory(ies) that work together to cause an apparatus, such as a mobile phone or server, to perform various functions). This definition of "circuitry" applies to all uses of this term in this application, including in any claims. As a further example, as used in this application and if applicable to the particular context, the term "circuitry" would also cover an implementation of merely a processor (or multiple processors) and its (or their) accompanying software/or firmware. The term "circuitry" would also cover if applicable to the particular context, for example, a baseband integrated circuit or applications processor integrated circuit in a mobile phone or a similar integrated circuit in a cellular network device or other network devices.

Pertinent internal components of the telephone include a Main Control Unit (MCU) 1103, a Digital Signal Processor (DSP) 1105, and a receiver/transmitter unit including a microphone gain control unit and a speaker gain control unit. A main display unit 1107 provides a display to the user in support of various applications and mobile terminal functions that perform or support the steps of causing traffic predictions based, at least in part, on decaying of real-time traffic data to historical traffic data. The display 1107 includes display circuitry configured to display at least a portion of a user interface of the mobile terminal (e.g., mobile telephone). Additionally, the display 1107 and display circuitry are configured to facilitate user control of at least some functions of the mobile terminal. An audio function circuitry 1109 includes a microphone 1111 and microphone amplifier that amplifies the speech signal output from the microphone 1111. The amplified speech signal output from the microphone 1111 is fed to a coder/decoder (CODEC) 1113.

A radio section 1115 amplifies power and converts frequency in order to communicate with a base station, which is included in a mobile communication system, via antenna 1117. The power amplifier (PA) 1119 and the transmitter/modulation circuitry are operationally responsive to the MCU 1103, with an output from the PA 1119 coupled to the duplexer 1121 or circulator or antenna switch, as known in the art. The PA 1119 also couples to a battery interface and power control unit 1120.

In use, a user of mobile terminal 1101 speaks into the microphone 1111 and his or her voice along with any detected background noise is converted into an analog voltage. The analog voltage is then converted into a digital signal through the Analog to Digital Converter (ADC) 1123. The control unit 1103 routes the digital signal into the DSP 1105 for processing therein, such as speech encoding, channel encoding, encrypting, and interleaving. In one embodiment, the processed voice signals are encoded, by units not separately shown, using a cellular transmission protocol such as enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wideband code division multiple access (WCDMA), wireless fidelity (WiFi), satellite, and the like, or any combination thereof.

The encoded signals are then routed to an equalizer 1125 for compensation of any frequency-dependent impairments that occur during transmission though the air such as phase and amplitude distortion. After equalizing the bit stream, the modulator 1127 combines the signal with a RF signal generated in the RF interface 1129. The modulator 1127 generates a sine wave by way of frequency or phase modulation. In order to prepare the signal for transmission, an up-converter 1131 combines the sine wave output from the modulator 1127 with another sine wave generated by a synthesizer 1133 to achieve the desired frequency of transmission. The signal is then sent through a PA 1119 to increase the signal to an appropriate power level. In practical systems, the PA 1119 acts as a variable gain amplifier whose gain is controlled by the DSP 1105 from information received from a network base station. The signal is then filtered within the duplexer 1121 and optionally sent to an antenna coupler 1135 to match impedances to provide maximum power transfer. Finally, the signal is transmitted via antenna 1117 to a local base station. An automatic gain control (AGC) can be supplied to control the gain of the final stages of the receiver. The signals may be forwarded from there to a remote telephone which may be another cellular telephone, any other mobile phone or a land-line connected to a Public Switched Telephone Network (PSTN), or other telephony networks.

Voice signals transmitted to the mobile terminal 1101 are received via antenna 1117 and immediately amplified by a low noise amplifier (LNA) 1137. A down-converter 1139 lowers the carrier frequency while the demodulator 1141 strips away the RF leaving only a digital bit stream. The signal then goes through the equalizer 1125 and is processed by the DSP 1105. A Digital to Analog Converter (DAC) 1143 converts the signal and the resulting output is transmitted to the user through the speaker 1145, all under control of a Main Control Unit (MCU) 1103 which can be implemented as a Central Processing Unit (CPU) (not shown).

The MCU 1103 receives various signals including input signals from the keyboard 1147. The keyboard 1147 and/or the MCU 1103 in combination with other user input components (e.g., the microphone 1111) comprise a user interface circuitry for managing user input. The MCU 1103 runs a user interface software to facilitate user control of at least some functions of the mobile terminal 1101 to causing traffic predictions based, at least in part, on decaying of real-time traffic data to historical traffic data. The MCU 1103 also delivers a display command and a switch command to the display 1107 and to the speech output switching controller, respectively. Further, the MCU 1103 exchanges information with the DSP 1105 and can access an optionally incorporated SIM card 1149 and a memory 1151. In addition, the MCU 1103 executes various control functions required of the terminal. The DSP 1105 may, depending upon the implementation, perform any of a variety of conventional digital processing functions on the voice signals. Additionally, DSP 1105 determines the background noise level of the local environment from the signals detected by microphone 1111 and sets the gain of microphone 1111 to a level selected to compensate for the natural tendency of the user of the mobile terminal 1101.

The CODEC 1113 includes the ADC 1123 and DAC 1143. The memory 1151 stores various data including call incoming tone data and is capable of storing other data including music data received via, e.g., the global Internet. The software module could reside in RAM memory, flash memory, registers, or any other form of writable storage medium known in the art. The memory device 1151 may be, but not limited to, a single memory, CD, DVD, ROM, RAM, EEPROM, optical storage, magnetic disk storage, flash memory storage, or any other non-volatile storage medium capable of storing digital data.

An optionally incorporated SIM card 1149 carries, for instance, important information, such as the cellular phone number, the carrier supplying service, subscription details, and security information. The SIM card 1149 serves primarily to identify the mobile terminal 1101 on a radio network. The card 1149 also contains a memory for storing a personal telephone number registry, text messages, and user specific mobile terminal settings.

Further, one or more camera sensors 1153 may be incorporated onto the mobile station 1101 wherein the one or more camera sensors may be placed at one or more locations on the mobile station. Generally, the camera sensors may be utilized to capture, record, and cause to store one or more still and/or moving images (e.g., videos, movies, etc.) which also may comprise audio recordings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method comprising:

determining one or more varying decay rates associated with one or more road segments;

acquiring, by way of a sensor, real-time traffic data associated with the one or more road segments;

decaying the real-time traffic data to historical traffic data associated with the one or more road segments based, at least in part, on the one or more varying decay rates, wherein the real-time traffic data is decayed in inverse proportion to an increasing proportion of historical traffic data;

determining one or more traffic predictions for the one or more road segments based, at least in part, on the decaying of the real-time traffic data to the historical traffic data;

creating at least one traffic profile for the one or more road segments based, at least in part, on the historical traffic data, wherein the at least one traffic profile represents expected traffic data for the one or more road segments; and displaying the at least one traffic profile on a user's mobile device.

2. A method of claim 1, further comprising:

determining the one or more varying decay rates with respect to one or more temporal parameters, wherein one or more different rates of the one or more varying decay rates are based, at least in part, on the one or more temporal parameters.

3. A method of claim 2, wherein the one or more temporal parameters include, at least in part, a time of day, a day of week, a month of year, a season, or a combination thereof.

4. A method of claim 1, further comprising:

storing the real-time traffic data in an on-board vehicle systems database;

processing the real-time traffic data, the historical traffic data, or a combination thereof to determine traffic speed variance data for the one or more road segments, wherein the one or more varying decay rates are further based, at least in part, on the traffic speed variance data.

5. A method of claim 4, further comprising:

increasing the one or more varying decay rates if the traffic speed variance data indicates a high variance above a threshold value; and decreasing the one or more varying decay rates if the traffic speed variance data indicates a low variance below a threshold value.

6. A method of claim 1, further comprising:

determining the one or more varying decay rates based, at least in part, on determining a deviation of the real-time traffic data from the at least one traffic profile.

7. A method of claim 6, further comprising:

decreasing the one or more varying decay rates if the deviation is above a threshold deviation value and traffic speed variance data is below a threshold variance value.

8. A method of claim 1, wherein the one or more varying decay rates include, at least in part, one or more static baseline values, one or more dynamic values, or a combination thereof for the one or more road segments, one or more time epochs, or a combination thereof.

9. A method of claim 8, further comprising:

specifying the one or more dynamic values for the one or more time epochs based on traffic speed variance data.

10. A method of claim 1, wherein the one or more decay rates are defined for all of the one or more road segments, one or more groups of the one or more road segments, individual ones of the one or more road segments, or a combination thereof.

11. An apparatus comprising:

at least one processor; and at least one memory including computer program code for one or more programs, the at least one memory and the computer program code configured to, with the at least one processor, cause the apparatus to perform at least the following, determine one or more varying decay rates associated with one or more road segments;

acquire, by way of a sensor, real-time traffic data associated with the one or more road segments;

decaying the real-time traffic data to historical traffic data associated with the one or more road segments based, at least in part, on the one or more varying decay rates, wherein the real-time traffic data is decayed in inverse proportion to an increasing proportion of historical traffic data;

determine one or more traffic predictions for the one or more road segments based, at least in part, on the decaying of the real-time traffic data to the historical traffic data;

create at least one traffic profile for the one or more road segments based, at least in part, on the historical traffic data, wherein the at least one traffic profile represents expected traffic data for the one or more road segments; and communicate the at least one traffic profile.

12. An apparatus of claim 11, further comprising:

determine the one or more varying decay rates with respect to one or more temporal parameters, wherein one or more different rates of the one or more varying decay rates are based, at least in part, on the one or more temporal parameters.

13. An apparatus of claim 11, further comprising:

processing the real-time traffic data, the historical traffic data, or a combination thereof to determine traffic speed variance data for the one or more road segments, wherein the one or more varying decay rates are further based, at least in part, on the traffic speed variance data.

14. An apparatus of claim 13, further comprising:

increasing the one or more varying decay rates if the traffic speed variance data indicates a high variance above a threshold value; and decreasing the one or more varying decay rates if the traffic speed variance data indicates a low variance below a threshold value.

15. An apparatus of claim 11, further comprising:

determine the one or more varying decay rates based, at least in part, on determining a deviation of the real-time traffic data from the at least one traffic profile.

16. An apparatus of claim 15, further comprising:

decreasing the one or more varying decay rates if the deviation is above a threshold deviation value and traffic speed variance data is below a threshold variance value.

17. An apparatus of claim 16, further comprising:

specifying one or more dynamic values for one or more time epochs based on traffic speed variance data.

18. A non-transitory computer-readable storage medium carrying one or more sequences of one or more instructions which, when executed by one or more processors, cause an apparatus to at least perform the following steps:

determining one or more varying decay rates associated with one or more road segments;

acquiring, by way of a sensor, real-time traffic data associated with the one or more road segments;

decaying the real-time traffic data to historical traffic data associated with the one or more road segments based, at least in part, on the one or more varying decay rates, wherein the real-time traffic data is decayed in inverse proportion to an increasing proportion of historical traffic data;

determining one or more traffic predictions for the one or more road segments based, at least in part, on the decaying of the real-time traffic data to the historical traffic data;

creating at least one traffic profile for the one or more road segments based, at least in part, on the historical traffic data, wherein the at least one traffic profile represents expected traffic data for the one or more road segments; and communicate the at least one traffic profile.

19. A non-transitory computer-readable storage medium of claim 18, further comprising:

determining the one or more varying decay rates with respect to one or more temporal parameters, wherein one or more different rates of the one or more varying decay rates are based, at least in part, on the one or more temporal parameters.

20. A non-transitory computer-readable storage medium of claim 18, further comprising:

determining the one or more varying decay rates based, at least in part, on determining a deviation of the real-time traffic data from the at least one traffic profile.

* * * * *